US007127818B2

(12) United States Patent
Sato et al.

(10) Patent No.: US 7,127,818 B2
(45) Date of Patent: Oct. 31, 2006

(54) ELECTRIC SHAVER

(75) Inventors: Masaaki Sato, Hikone (JP); Hiroyuki Kameoka, Hikone (JP); Takeshi Shiba, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/546,598

(22) PCT Filed: Feb. 25, 2004

(86) PCT No.: PCT/JP2004/002188

§ 371 (c)(1),
(2), (4) Date: Aug. 23, 2005

(87) PCT Pub. No.: WO2004/076135

PCT Pub. Date: Sep. 10, 2004

(65) Prior Publication Data

US 2006/0150421 A1 Jul. 13, 2006

(30) Foreign Application Priority Data

Feb. 25, 2003 (JP) ..... 2003-048301

(51) Int. Cl.
*B26B 19/04* (2006.01)
*B26B 19/12* (2006.01)

(52) U.S. Cl. ..... 30/43.7; 30/346.51

(58) Field of Classification Search ..... 30/43.7, 30/43.8, 43.91, 43.92, 346.51
See application file for complete search history.

(56) References Cited

U.S. PATENT DOCUMENTS 5,398,412 A 3/1995 Tanahashi et al.
6,219,920 B1 4/2001 Klein
6,381,849 B1 * 5/2002 Eichhorn et al. ..... 30/43.92
2002/0059729 A1 5/2002 Ikuta et al.
2005/0144784 A1 7/2005 Ibuki et al.

FOREIGN PATENT DOCUMENTS

GB 1160015 6/1967

(Continued)

OTHER PUBLICATIONS

English language Abstract of JP 7-250979.

(Continued)

*Primary Examiner*—Derris H. Banks
*Assistant Examiner*—Sean M. Michalski
(74) *Attorney, Agent, or Firm*—Greenblum & Bernstein, P.L.C.

(57) ABSTRACT

An electric shaver is provided which can enhance the vibration sound by increasing the length of arch-like edges formed between adjacent slots of the inner blade. In the electric shaver, an inner blade having the arch-like edges is moved reciprocally while its outer face contacts with and slides over an inner face of an outer blade to cut beard. The inner blade has an arch-like plate member, as a main body of the inner blade, and it has slots extending from a side wall through a top curved portion to the other side wall, to form arch-like edges between adjacent slots, and the inner blade is connected through a joint to a driver of the main body to be moved reciprocally. Mounting members for the joint are provided at two ends of the inner blade in the longitudinal direction, and the lower ends of the edges at the central portion of the inner blade are set lower than the lower ends of the beads formed above the mounting members of the inner blade.

20 Claims, 9 Drawing Sheets

FOREIGN PATENT DOCUMENTS

| | | |
|---|---|---|
| JP | 55-99286 | 7/1980 |
| JP | 4-176490 | 6/1992 |
| JP | 7-250979 | 10/1995 |
| JP | 8-150269 | 6/1996 |
| JP | 2002-58887 | 2/2002 |
| JP | 2004-16520 | 1/2004 |

OTHER PUBLICATIONS

English language Abstract of JP 4-176490.
English language Abstract of JP 55-99286.
English language Abstract of JP 8-150269.
English language Abstract of JP 2002-28887.
English language Abstract of JP 2004-16520.

* cited by examiner

ELECTRIC SHAVER

TECHNICAL FIELD

The invention relates to an electric shaver for cutting beard by sliding an inner blade over an outer blade.

BACKGROUND ART

In a prior art electric shaver, an inner blade having slots performs a reciprocating motion while sliding over an outer blade to cut beard between them (for example, Japanese Patent laid open Publication H7-250979). A plate sheet, as a main body of the inner blade, has an arch-like (or of inverse-U-character-like) section in a direction perpendicular to the longitudinal direction thereof, and it has a plurality of the slits in parallel to each other, extending from a side wall through the top curved portion to another side wall. An arch-like edge is formed between two adjacent slits, and the edge of the curved portion is a cutting edge. The outer blade is formed so that its inner face makes contact with and slides over an outer face of the inner blade. The outer blade is mounted to a main body of the electric shaver, while the inner blade is connected via a joint to a driver at the top of the main body. The inner blade fixed to the joint so that the outer plane thereof is provided along the inner face of the outer blade, and the joint to which the inner blade is fixed is connected to the driver at the top of the main body, and it is driven so that the longitudinal direction of the inner blade agrees with the direction of the reciprocating motion of the driver. The above-mentioned prior art inner blade has fixing members to the joint at the bottom end at the central portion in the longitudinal direction of the two side walls of the arch-like inner blade.

Some of such electric shavers generate a cutting sound due to vibrations of the edges of the inner blade when the inner and outer blades bite and cut beard between them. The cutting sound or vibration sound of the edges is used to judge the shaving state of beard. In order to judge the shaving state better, the vibration sound might be enhanced by increasing the length of the edges. However, when the fixing members to the joint are provided at the central portion in the longitudinal direction, the lower end of the edges at the central portion cannot be extended lower due to interference of the fixing portions, and the length of the edges cannot be increased. Therefore, the length of the edges cannot be increased as far as the height of the generally U-character-like inner blade is not increased.

The invention intends to solve this problem, and its object is to provide an electric shaver which can enhance the vibration sound by increasing the length of the arch-like edges formed between adjacent slots of the inner blade.

DISCLOSURE OF INVENTION

It is an object of the invention to provide an electric shaver which can enhance the sound due to the cutting of beard by increasing the length of the arch-like edges formed between adjacent-slots of the inner blade.

An electric shaver according to the invention has an inner blade (1) with slits (12) in reciprocating motion, so that its outer face contacts with and slides over an inner face of an outer blade (20) for cutting beard. The electric shaver includes a driver (41) provided at an end of a main body, being able to perform a reciprocating motion, a joint (3) connected to the driver (41), the inner blade (1) with the slits, and the outer plate (20) in contact with and sliding over the outer face of the inner blade (1). The inner blade (1) has a plate member (12) with an arch section in a direction perpendicular to a longitudinal direction of the plate member (12) and mounting members provided at two ends of the plate member in the longitudinal direction and being connected with the joint (3). The outer blade (20) is supported by the main body and has an inner space to contain the inner blade (1), wherein its inner face contacts with and slide over an outer face of the inner blade (1). The plate member (11) of the inner blade (1) has arch-like slits (12) provided in parallel to each other to form arch-like edges (14) between adjacent slits (12). A bottom end (15*a*) of edges (14*a*) formed at a central portion of the plate member in the longitudinal direction is lower than a bottom end (15*b*) of other edges (14*b*) near the mounting member when a top of the arch-like section of the plate member (11) is viewed high and the driver is viewed low. Thus, as to the inner blade (1) which needs to provide the fixing members to the joint (3), the fixing members (16) are provided at side walls (11*a*) at the lower side of the edges (14*a*) at two ends in the longitudinal direction of the inner blade (1) which is not likely be used for cutting beard, while increasing the length of edges (14*a*) at the central portion used frequently for cutting beard. Thus, the sound on cutting beard can be enhanced effectively, so that the cutting state can be judged well.

Preferably, the bottom end (15*a*) of the edges (14*a*) formed at a central portion of the plate member in the longitudinal direction is lower than a top end of the mounting member (16) of the plate member. Then, the length of the edges can be longer at the central portion in the longitudinal direction.

Preferably, a position of the bottom end (15*a*) of a plurality of the edges (14*a*) formed at the central portion of the inner blade (1) is not constant in the up-and-down direction. Thus, the sound due to cutting can be enhanced, while suppressing the deterioration of cutting property due to decrease in rigidity.

Preferably, a position of the bottom end ($\mathbf{15}a_1$, $\mathbf{15}a_2$) is different in the up-and-down direction between adjacent edges ($\mathbf{14}a_1$, $\mathbf{14}a_2$) in a plurality of the edges (14*a*) formed at the central portion. Thus, deterioration of cutting property can be suppressed by providing longer edges (14*a*) continuously.

Preferably, the driver (41) has a transmission member which transmits reciprocal motion to the joint (3) provided in the inner blade. Thus, the electric shaver can be fabricated compactly without increasing the height of the inner blade (1) with the longer edges (14).

Preferably, a member (36) for preventing detachment of the driver (41) from the joint (3) is provided further inside the inner blade (1). Thus, the electric shaver can be fabricated compactly without increasing the height of the inner blade (1) having the longer edges (14).

BEST MODE FOR CARRYING OUT THE INVENTION

Embodiments of the invention will be explained below with reference to the attached drawings.

Figure 5:
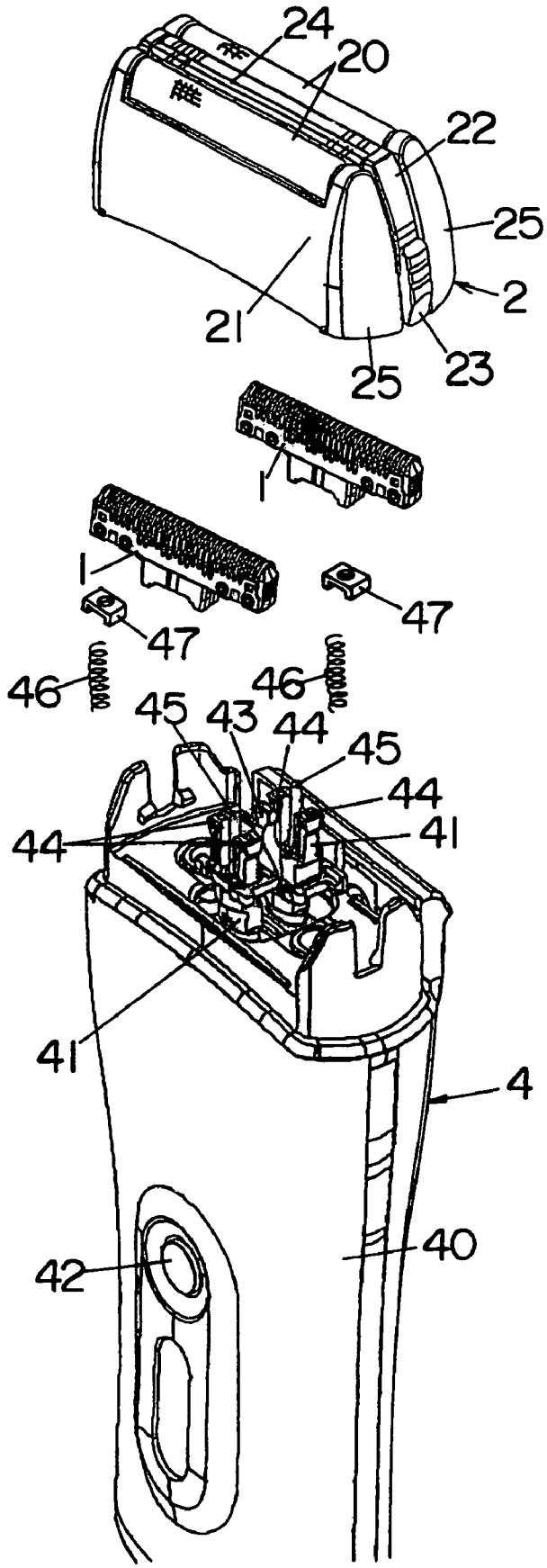
FIG. 5 is a perspective exploded view of the electric shaver with parts broken away partially.
Figure 6:
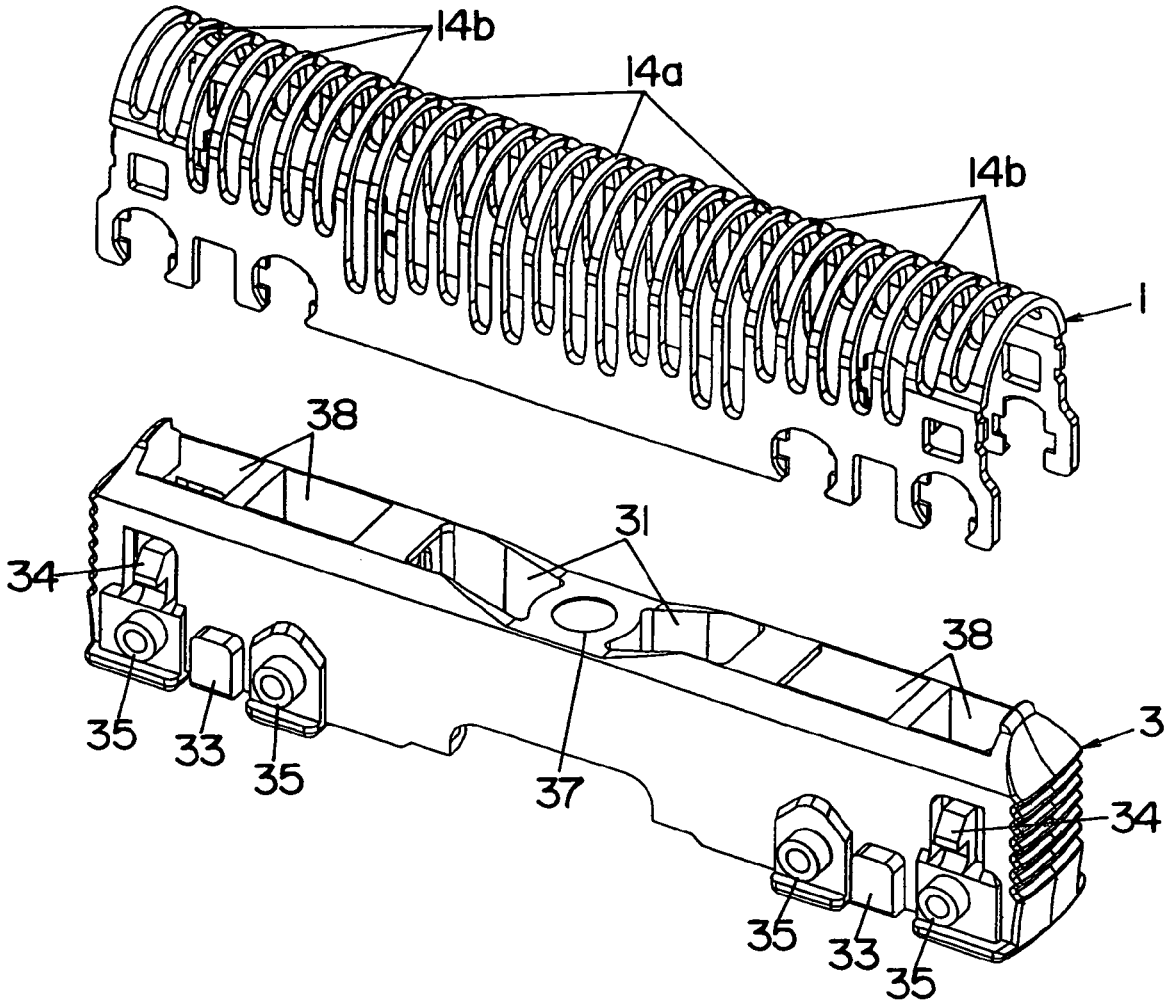
FIG. 6 is a perspective exploded view of an inner blade and a joint of an electric shaver according to another embodiment of the invention.
Figure 7:
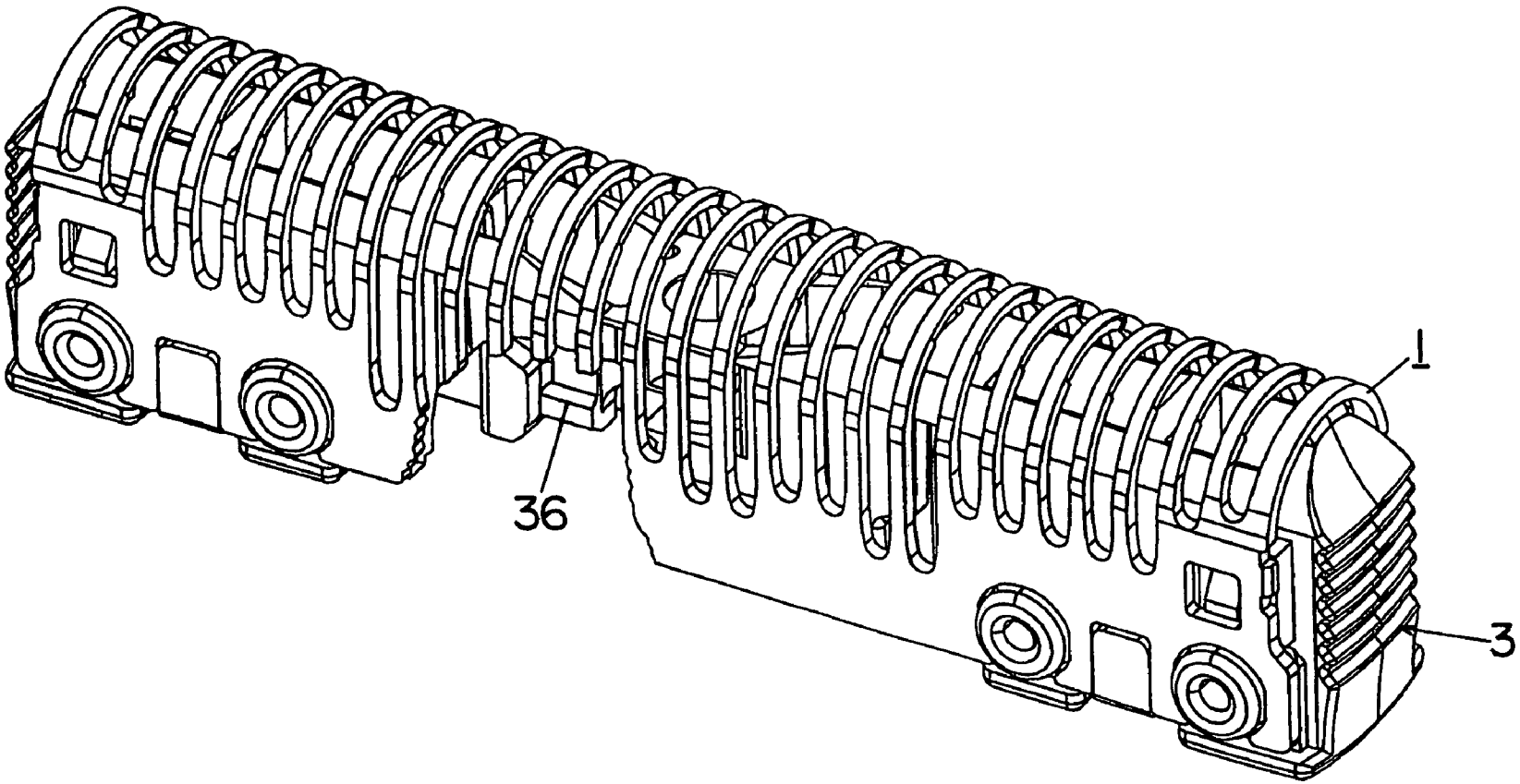
FIG. 7 is a perspective view of the inner blade fixed to the joint with parts broken away.
Figure 8:
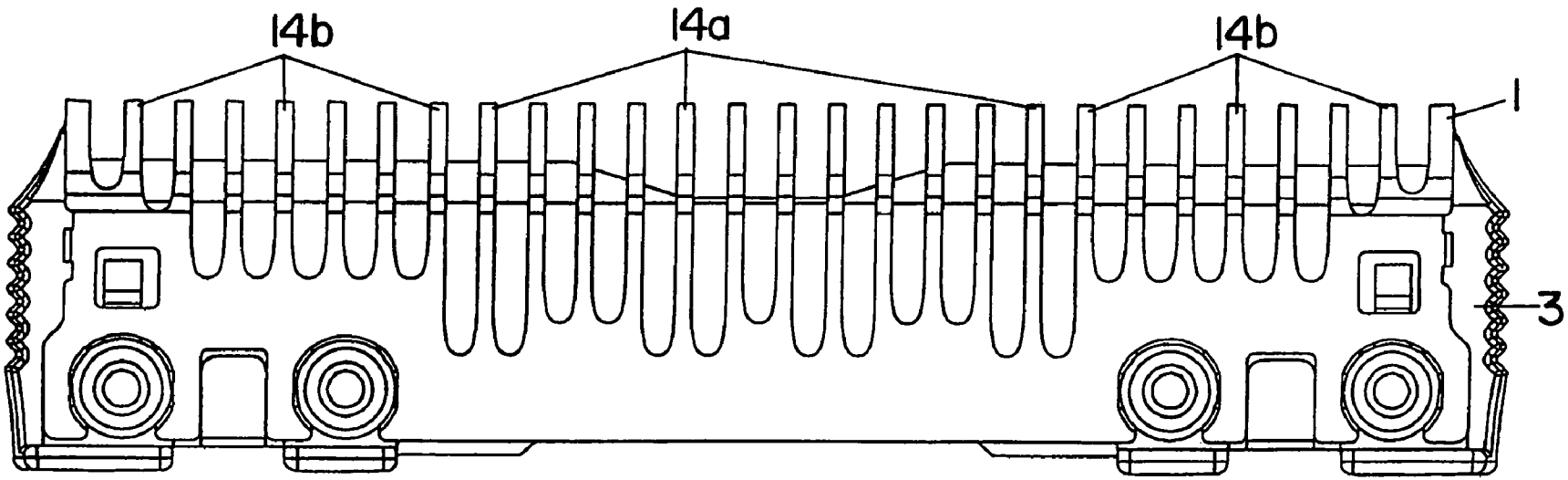
FIG. 8 is an elevation view of the inner blade fixed to the joint.
Figure 9:
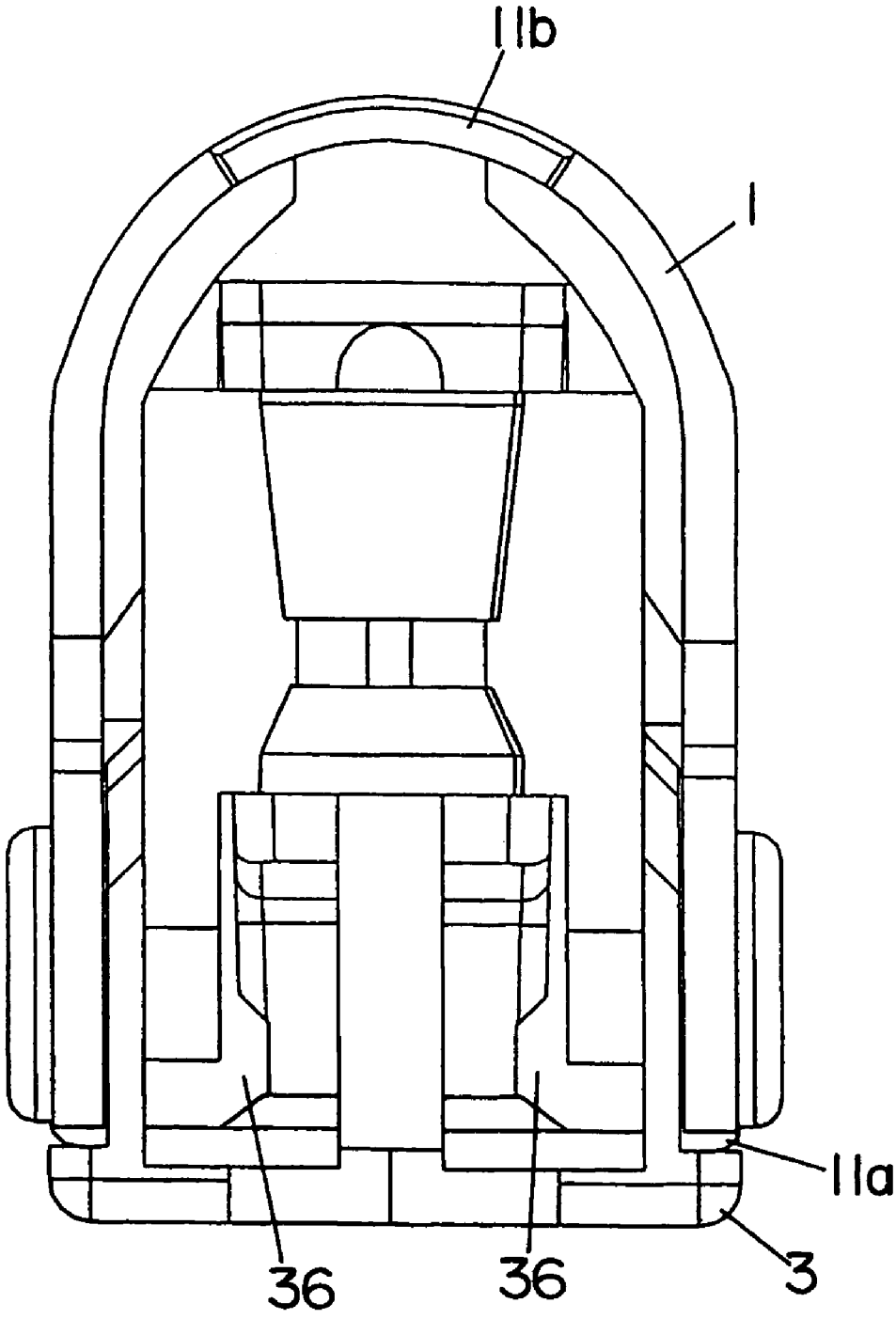
FIG. 9 is a side view of the inner blade fixed to the joint.

First, the entire structure of an electric shaver according to a first embodiment is explained with reference to FIG. 5. The electric shaver mainly consists of an outer blade cassette 2 and a main body 4 of the electric shaver. The outer blade cassette 2 has two outer blades 20, while the main body 4 has drivers 41 at the top end thereof, joints 3 and two inner blades 1 being mounted on the drivers 41. When the drivers are moved reciprocally, an outer face of the inner blade 1 contacts with and slides over an inner face of the outer blade 20.

The outer blade cassette 2 is explained here. An outer frame thereof has two float supporters 21 provided at two sides when viewed in the back-and-forth direction and a slit supporter 22 located between the float supporters 21. A net blade cassette 23 has the net-like outer blades 20 at the top of the two float supporters 21. A slit blade cassette 25 has the outer blades 20 and a slit blade 24 at the top of the slit holder 22. Therefore, the outer blades 20 are provided at two ends in the back-and-forth direction, and the slit blade 24 is provided between the two outer blades 20. The outer blade cassette 2 is connected to the top of the main body 4 so that it has the float supporters 21 and the slit holder 22 (outer frame) floatable or movable in the top-and-bottom direction and tiltable in the longitudinal direction. The two outer blades 20 of the outer blade cassette 2 correspond to the inner blades 1 of the main body 4.

The main body 4 of the electric shaver houses reciprocal drivers (not shown) such as a linear motor and an electric power supply such as a battery (not shown) for driving the reciprocal drivers in a grip case 40 used as an outer frame, and it has a switch 42 for turning on or off the power supply at an outer plane of the grip case 40. In the explanation of the electric shaver, "front" means the side wherein the switch 42 is provided, and "rear" means the side opposite to the front. Further, the "up-and-down direction" means a direction where the outer blade cassette 2 is up and the main body 4 is down.

At the top of the main body 4, two drivers to be driven reciprocally are provided at the front and rear sides in the reciprocal drivers. The two drivers 41 are provided at positions in correspondence to the two outer blades 20 mentioned above. Further, a lever 43 for slit driving is added to one of the drivers at a position in correspondence to the slit blade 24.

The bottom ends of the bases (not shown) of the drivers 41 are connected directly or indirectly to the reciprocal driver in the grip case 40. At the top of the base of the drivers 41, two engaging members 44 protrude upward at the right and left sides, and an engaging pin 45 protruding upward is provided between the two engaging members 44. The drivers 41 are connected to the joints 3 to which the inner blades 1 are fixed.

Figure 1:
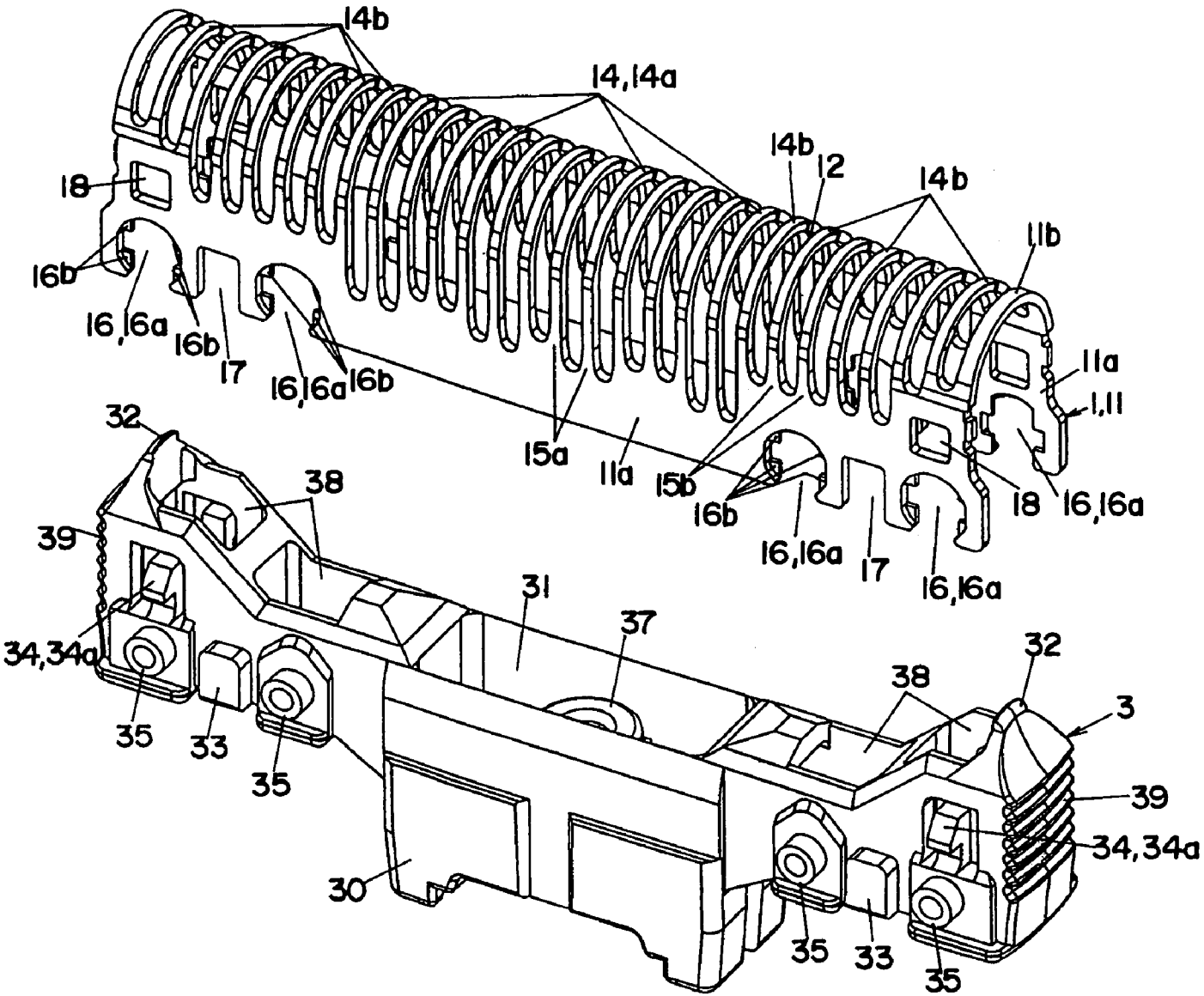
FIG. 1 is a perspective exploded view of an inner blade and a joint of an electric shaver according to an embodiment of the invention.
Figure 2:
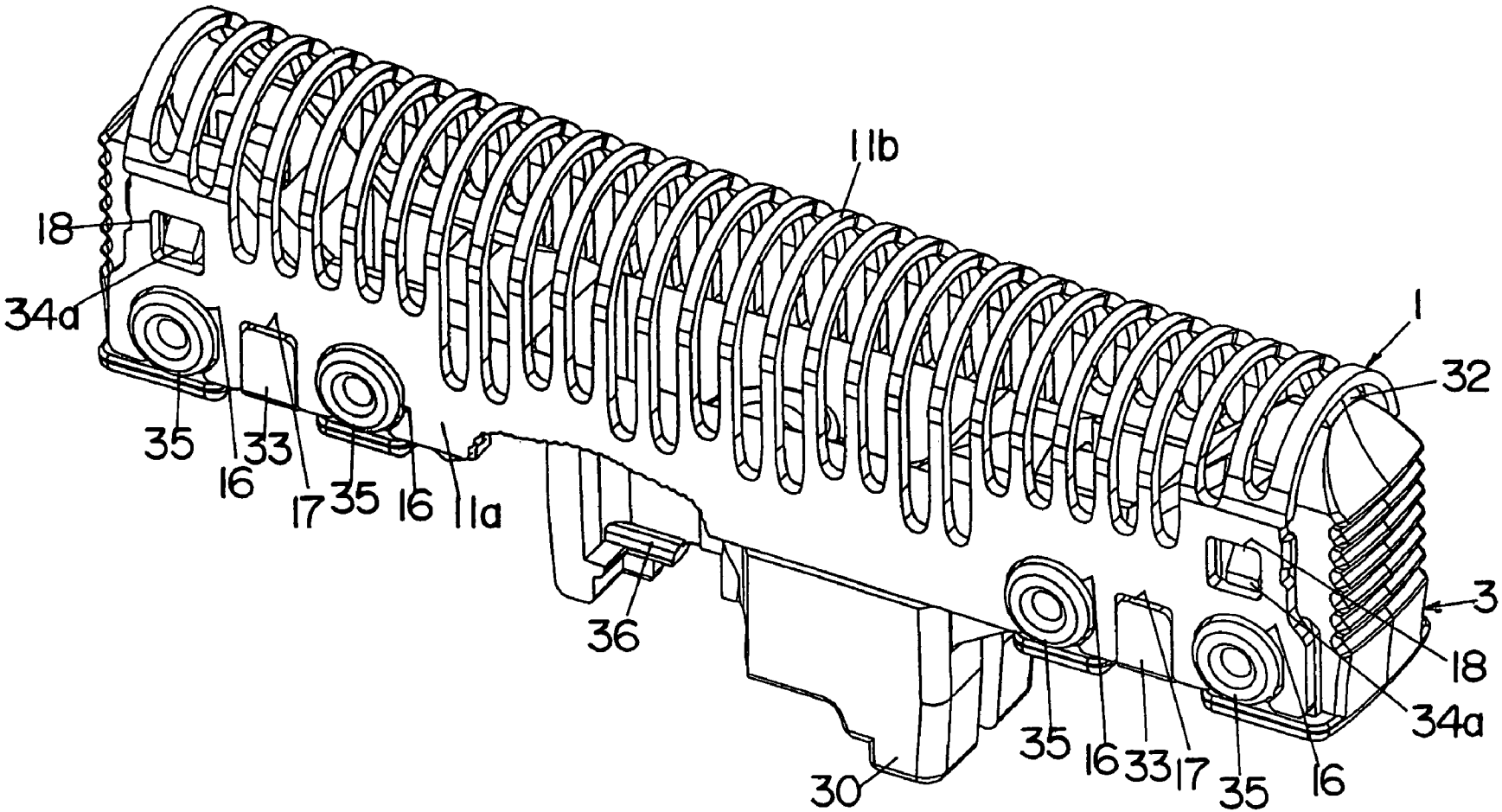
FIG. 2 is a perspective view of the inner blade fixed to the joint with parts broken away.
Figure 3:
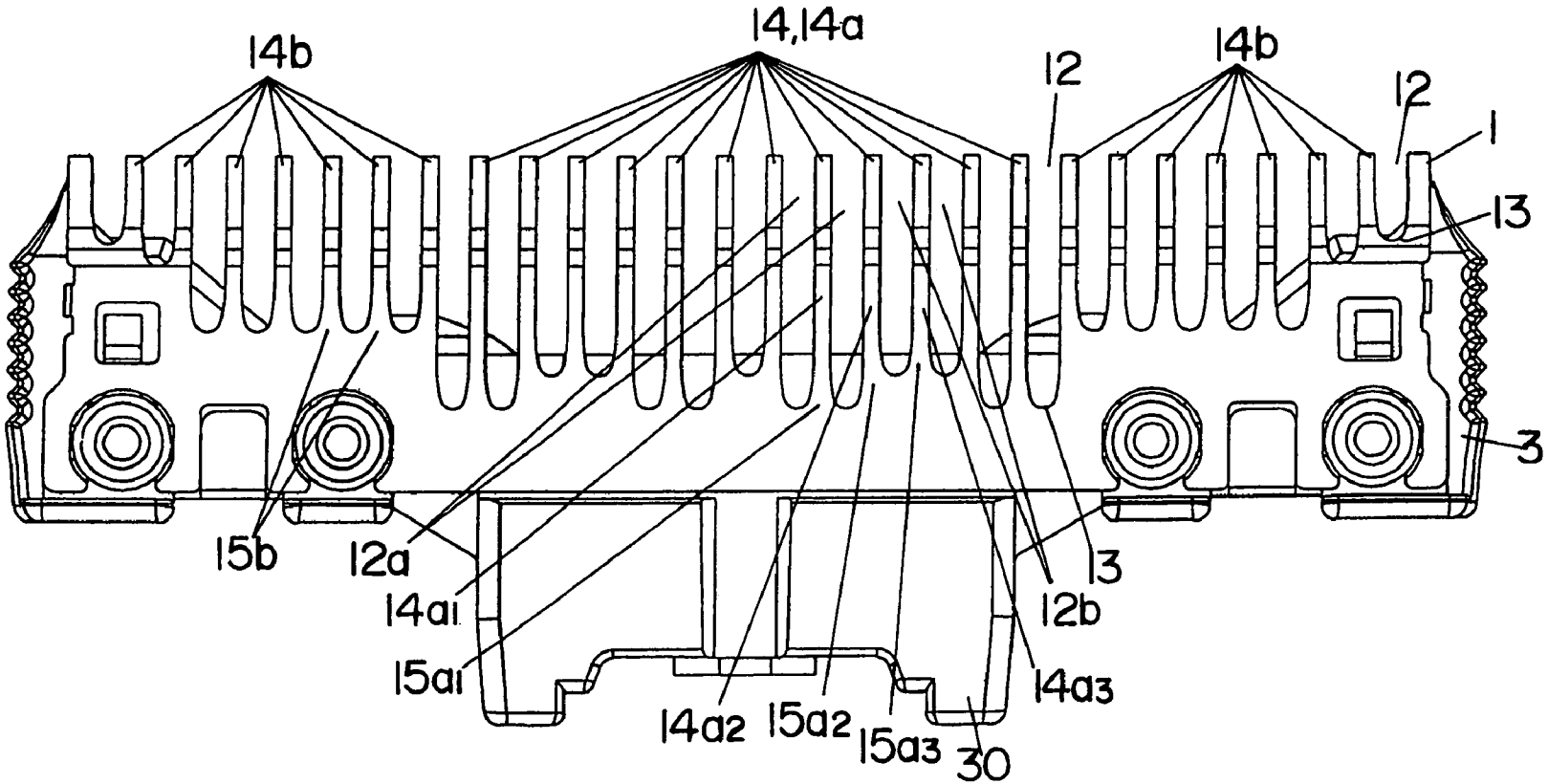
FIG. 3 is an elevation view of the inner blade fixed to the joint.
Figure 4:
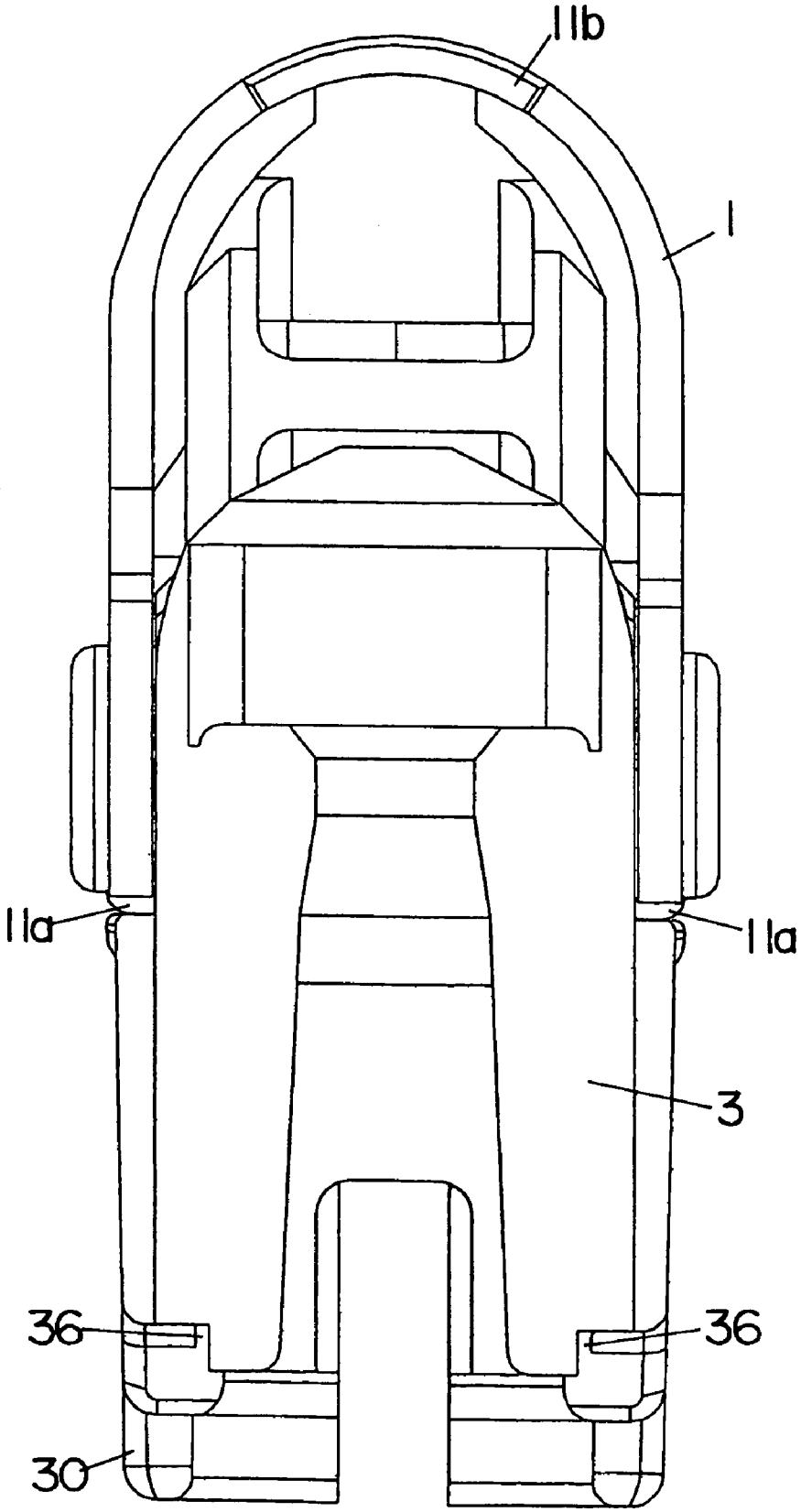
FIG. 4 is a side view of the inner blade fixed to the joint.

The inner blades 1 and the joints 3 are explained here. FIG. 1 is a perspective exploded view of the inner blade 1 and the joint 3, while FIGS. 2 and 3 are a perspective view with parts broken away and an elevation view in a state where the inner blade and the joint are fixed, respectively. As shown in FIGS. 1 to 3, the inner blade 1 has a plate sheet 11 curved like an arch (or in an inverse-U-character-like) when viewed in a side way (or in the longitudinal direction). (Therefore, a section of the plate sheet 11 is arch-like in a direction perpendicular to the longitudinal direction.) The plate sheet 11 is curved to form a curved plane having an arch-like curved wall (a wall curved to protrude in the upward direction) between two side walls arranged in parallel, and it is open at the bottom. The plate sheet 11 has a plurality of slits 12 in parallel to each other in the longitudinal direction extending from the side wall 11*a* through the curved wall 11*b* to the other side wall 11*a*, and an arch-like portion between two adjacent slits forms an edge 14. When the inner blade 1 is moved reciprocally in the longitudinal direction thereof, the edges of the blade 14 in the width direction at the curved portion (or in the longitudinal direction of the inner blade 1) become cutting edges. The two bottom ends 15 of the edge 14 extend to the side walls 11a of the plate sheet 11.

The inner blade 1 has fixing members 16 for fixing to the joints 3 at two positions at each of the bottom ends of the two ends of the side walls 11*a* in the direction of the reciprocal motion (or in the longitudinal direction) for each of the two inner blades 1. The fixing member 16 is subjected to heat sealing with a boss 35 of the joint 3 to be mentioned below, and it has a boss hole 16*a* opened at the lower side of the side wall 11*a* and thin pieces 16*b* protruding from a brim of the hole 16*a* into the hole 16*a*. The boss hole 16*a* is formed to have an opening somewhat wider than the boss 35 in order to insert the boss 35 from the opening at the lower end. Further, the pieces 16*b* thinner than the plate sheet 11 protrude from an end of the brim at the interior side (or at the inner side in a plan view) of the hole 16*a*. Four thin pieces 16*a* or two pairs of the thin pieces 16*b* are provided above and below, wherein the distance between top ends of the opposing two pieces 16*b* in the longitudinal direction of the inner blade 1 is somewhat larger than the size of the boss 35 and of about the same order as the opening width of the boss hole 16*a*.

Further, each of the inner blades 1 has four square recesses 17 for positioning relative to the joints 3 at the lower ends of the two ends of the two side walls 11*a* in the direction of the reciprocating motion (or in the longitudinal direction) of the inner blade 1. The square recesses 17 are provided between the fixing members 16 mentioned above in this embodiment. The square recesses 17 fit with square projections for positioning to be mentioned below, and they are rectangular and are open towards the lower end of the side wall 11*a*.

Further, the inner blade 1 has four square windows for each inner blade 1 for preventing detachment from the joints 3, at the two ends of the two side walls 11*a* of the inner blade 1 in the direction of reciprocal motion (or in the longitudinal direction). In this embodiment, the square windows 18 are provided above the fixing members 16 at the outside of the side walls (or at the outside in the longitudinal direction). The square window 18 has a generally rectangular opening, and it engages with the engaging member 34 of the joint 3 to be explained later for preventing detachment.

Next, the joint 3 is explained. As shown in FIGS. 1 to 3, the joint 3 is fitted along the inner lower face of the arch-like inner blade 1, and it has a similar shape to the inner blade in a plan view (or more precisely, smaller by the thickness of the plate sheet 11 of the inner blade 1. Further, its height in the up-and-down direction is also similar to that of the inner blade 1 at the two ends in the longitudinal direction, and it has the fixing member 30 for the main body which protrudes lower than the inner blade at the central portion in the longitudinal direction.

The joint 3 has a float square hole 31 which is generally rectangular and is open through in the up-and-down direction. The float square hole 31 is provided inside the fixer 30 mentioned above, so that the fixer 30 has a shape of a generally cylindrical square.

First, the connection with the inner blade 1 and portions relevant to the connection are explained. The joint 3 is fitted and fixed by being covered by the lower opening of the inner blade 1 to be fitted along the inner lower face of the inner blade 1. Because the front and rear faces of the joint 3 fit to the inner face of the two side walls 11*a* of the inner blade 1, positioning thereof is not needed in the back-and-forth direction. As to the up-and-down direction, it is only needed to insert the inner blade 1 until the lower face of the top of the curved wall 11*b* of the inner blade 1 contacts with the top of the joint 3. In this embodiment, receptors 32 for the inner blades 1 are provided at the top ends of the two ends in the longitudinal direction of the joint 3, and they contact with the lower faces of the tops of the curved walls 11*b* of the inner blades 1 for positioning in the up-and-down direction. Further, as to the positioning in the longitudinal (left-and-right) direction, the square recesses 17 mentioned above are provided in the inner blade 1, and square protrusions 33 are provided in the joint 3 at positions to fit with the square recesses 17 of the inner blades 1 when the inner blades 1 are fixed to the joints 3. The square recesses 17 and the square protrusions 33 are used for the positioning. The square protrusion 33 has a generally rectangular shape similar to the rectangular recess 17, and it protrudes towards the outside in the back-and-forth direction. When it is inserted into the square recess 17 from below, the positioning in the left-and-right direction is performed. The inner blades 1 and the joints 3 are positioned and fixed in this way while preventing detachment.

The detachment is prevented by the engaging member 34 to be engaged with the square window 18 of the inner blade 1 mentioned above. The engaging member 34 has a hook 34*a* provided at a position in correspondence to the square window 18 in the engaged state, and the hook 34*a* protrudes towards the outside in the back-and-forth direction. When the joint 3 is fit to the inner blade 3, the hook 34*a* is pressed to the side wall 11*a* of the inner blade 1 to be fit inwardly to the joint 3 elastically, and when the square window 18 is positioned, it is inserted through the square window 18 and protrudes due to a returning force towards the outside. Thus, the engaging member 34 is engaged at the lower inner brim of the square window 18 to prevent detachment of the inner blade 1 from the joint 3.

The inner blade 1 is fixed with the joint 3 while performing the positioning and the prevention of the detachment. The fixing is performed by heat sealing with the heat seal boss 35 of the joint 3 to the fixing member 16 of the inner blade 1 mentioned above. The boss 35 is cylindrical, and it is provided at a position in correspondence to the fixing member 16 of the inner blade 1 in the fixed state, protruding towards the outside in the back-and-forth direction. The boss 35 is fixed by heat sealing in a state wherein it is crimpled to the outer face of the thin protrusion 16*b* and to the outer face of the side wall 11*a* of the inner blade 1 so that the inner blade 1 is connected to the joints 3 as an integral body.

The joint 3 has a member 36 for preventing detachment of the driver 41 from the joint 3 to protrude towards the float square hole 31 at the lower end of the fixing member 30, and a cylindrical member 37 to be engaged as a pin connection inside the float square hole 31. When the engaging member 44 of the driver 41 is inserted from below into the float square hole 31 for the connection, the top of the engaging member 44 contacts to the top face of the detachment-preventing member 36 so as for the joint 3 not to be detached from the engaging member 44. In the engaged state, the joint 3 is spring-loaded upward to prevent the detachment from the engaging member 44. For creating the spring loading, a coil-like spring 46 is put on an engaging pin 45 of the driver 41 from above, and a plate-like stopper 47 is provided at a top end of the spring 46. Then, the float square hole 31 of the driver 41 is covered over the engaging pin 44 of the driver 41, and the stopper 47 is provided at a top end of the spring 46. Further, the float square hole 31 of the joint 3 is covered over the engaging member 44 of the driver 41, and the stopper 47 is pushed down to cover the cylindrical member 37 of the joint 3 over the pin 45 of the driver 41 provided at the top end of the spring 46. Then, as mentioned above, the engaging member 44 of the driver 41 is fixed to the detachment-preventing member 37 of the float square hole 31 of the joint 3. The stopper 47 contacts with the bottom end of the joint 3 to exert an upward force, so that the joint 3 to which the inner blade 1 is fixed is floatable relative to the driver 41.

Further, the joint 3 has holes 38 at the two sides of the float square hole 31 in the longitudinal direction, and the holes 38 go through in the up-and-down direction to drop beard. Still further, a plurality of uneven patterns are formed at the two sides in the longitudinal direction to form holders 39 used for holding the joint 3.

As mentioned above, the inner blade 1 has slits 12 along the entire length in the direction of reciprocal motion (or in the longitudinal direction) to form edges 14. Because the fixing members 16, the square recesses 17 and the square windows 18 are formed at the two ends in the direction of reciprocal motion, the bottom ends 13 of the slits 12 (and the bottom ends 15*b* of the edges 14*b*) at the two ends in the direction of reciprocal motion of the inner blade 1 are formed at an upper position than the bottom ends 13 of the slits 12 (and the bottom ends 15*a* of the edges 14*b*) provided at the central portion in the direction of reciprocal motion of the inner blade 1. Therefore, the length of the edges is set so that the edges 14*a* at the central portion are longer than the edges 14*b* at the two ends in the direction of reciprocal motion.

When beard is caught and cut off with the inner and outer blades 1, 20, the edges 14 of the inner blade 1 vibrate to create a cutting sound (or a vibration sound of the edges 14), and the sound makes it possible to decide the shaving state. In this embodiment, in order to decide the shaving state well, the length of the edges 14 is formed longer to enhance the vibration sound of the edges 14. Because the inner blade 1 needs the fixing members 16 for mounting the joint 3, if all the edges 14 are longer, there is no space for providing the fixing members 16. Therefore, in this embodiment, the positions of the fixing members 16 are provided not at the central portion of the inner blade 1, but at the two ends in the longitudinal direction, and the edges at the central portion become longer. When the beard is cut off, the portion of the edges 14*a* at the central portion in the direction of reciprocal motion is easily applied to skin. Further, because the inner blade 1 and the outer blade 20 are moved relatively to each other reciprocally in the longitudinal direction, the edges

14*a* at the central portion always contribute to cut off beard, or the edges 14*a* at the central portion is used most frequently. Then, only the edges 14*a* at the central portion are lengthened to enhance the cutting sound effectively.

In the above-mentioned structure, the fixing members 16 for the joint 3 are provided at the side walls 11*a* below the edges 14*b* at the two ends in the longitudinal direction of the inner blade 1 not used so often for cutting beard, while the length of the edges 14*a* at the central portion is set longer. Thus, the sound for cutting beard can be enhanced effectively to decide the cutting status well.

Further, in this embodiment, the lower ends 15*a* of the edges 14*a* at the central portion in the longitudinal direction are extended lower than the lower ends 15*b* of the edges 14*b* at the two ends in the longitudinal direction, so that the lower ends 15*a* are lower than the top ends of the fixing members 16. Thus, the length of the edges 14*a* at the central portion is increased still longer.

Still further, in this embodiment, the positions of the lower ends 15*a* of the edges 14*a* at the central portion in the longitudinal direction are different or the lengths of the edges are different. As to the length of the edges, it is preferable to be longer as far as possible in order to enhance the cutting sound, but as to the cutting characteristic, the edge becomes dull due to large deflection on cutting when the blade length is longer. Therefore, in order to suppress the dull edge while enhancing the cutting sound, the edges 14*a* at the central portion has two or more lengths, for example, a shorter length and a longer length, in order to prevent decrease in rigidity due to increase in length of the edges 14*a*. Then, the cutting sound is kept large while the, dull edge due to decrease in rigidity can be prevented. Especially, because the positions of the lower ends 15*a*1 and 15*a*2 in the up-and-down direction of adjacent edges 14*a*1 and 14*a*2 are changed to have non-constant lengths of the edges, the longer edges 14*a* are not arranged continuously. Thus, the decrease in edge dullness due to continuous arrangement of longer edges 14*a* can be suppressed. In this embodiment, as shown in FIG. 3, there are three types of edges, that is, edges 14*a*1 between two slits 12*a*, edges 14*a*2 between two slits 12*a* and 12*b*, and edges 14*a*3 between two slits 12*b*, wherein the length of the edges 14*a*1>length of the edges 14*a*2>length of the edges 14*b*.

Next, a second embodiment of the invention is explained with reference to FIGS. 6 to 9. This embodiment is generally similar to the first embodiment shown in FIGS. 1 to 5, and like reference characters designate like structures and explanation thereof is omitted here. Different points are explained below mainly.

In the second embodiment, the joint 3 is different from the counterpart in the first embodiment. In the first embodiment, the members 30 for fixing to the main body extend lower than the inner blade 1 at the central portion in the longitudinal direction of the joint 3, while in this embodiment, no members are provided extending lower than the inner blade 1.

That is, a float square hole 31 is formed through the center of the joint 3 in the longitudinal direction, and the lower end of the float square hole 31 is not lower than the two ends of the joint 3 in the longitudinal direction. At the lower end of the hole 31, a member 36 for preventing detachment is protruded towards the inside of the hole 31, while a cylindrical member 37 for pin engagement is arranged in the hole 31.

Thus, an engaging member 44 of the driver 41 to be connected to the joint 3 is not lower than the inside of the fixing member 30 or the two ends of the joint in the longitudinal direction, in contrast to the first embodiment, and it is provided inside the joint 3 (and between the side walls 11*a* of the inner blade 1). Further, the member 36 for stopping detachment is not lower than the two ends of the joint 3 in the longitudinal direction similarly, and it is arranged inside the joint 3 (and between the side walls 11*a* of the inner blade 1). Therefore, the edges 14 becomes longer, while the arch-like curved wall of the inner blade 1 is not made higher and the electrical shaver is kept compact.

Though the invention is explained above with reference to the embodiments, but the invention can be changed or embodied in still other ways without departing from the essential character thereof.

The invention claimed is:

1. An electric shaver wherein an inner blade with slots is moved reciprocally and its outer face contacts with and slides over an outer blade for cutting beard, the electric shaver comprising:

a driver provided at an end of a main body, being able to perform a reciprocating motion;

a joint connected to said driver;

said inner blade having a plate member, said plate member having an arch section perpendicular to a longitudinal direction of the plate member and mounting members provided at two ends of the plate member in the longitudinal direction and being connected with said joint; and said outer blade supported by the main body and having an inner space to contain said inner blade, wherein its inner face contacts with and slide over an outer face of said inner blade to cut beard when said inner blade connected to said joint is moved by said driver in reciprocating motion;

wherein the plate member of said inner blade has arch slits provided in parallel to each other to form arch edges between adjacent slits; and wherein a bottom end of edges formed at a central portion of the plate member in the longitudinal direction is lower than a bottom end of different edges formed near the mounting member when a top of the arch section of the plate member is viewed high and said driver is viewed low.

2. The electric shaver according to claim 1, wherein the bottom end of the edges formed at a central portion of the plate member in the longitudinal direction is lower than a top end of the mounting members of the plate member.

3. The electric shaver according to claim 1, wherein a position of a plurality of the edges formed at the central portion is not constant in the vertical direction.

4. The electric shaver according to claim 1, wherein a position of the bottom end is different between adjacent edges in a plurality of the edges formed at the central portion.

5. The electric shaver according to claim 1, wherein said driver has a transmission member which transmits reciprocal motion to said joint provided in said inner blade.

6. The electric shaver according to claim 1, further comprising a member for preventing detachment of said driver from said joint in said inner blade.

7. The electric shaver according to claim 2, wherein a position of a plurality of the edges formed at the central portion is not constant in the vertical direction.

8. The electric shaver according to claim 2, wherein a position of the bottom end is different between adjacent edges in a plurality of the edges formed at the central portion.

9. The electric shaver according to claim 2, wherein said driver has a transmission member which transmits reciprocal motion to said joint provided in said inner blade.

10. The electric shaver according to claim 2, further comprising a member for preventing detachment of said driver from said joint in said inner blade.

11. The electric shaver according to claim 3, further comprising a member for preventing detachment of said driver from said joint in said inner blade.

12. The electric shaver according to claim 3, wherein said driver has a transmission member which transmits reciprocal motion to said joint provided in said inner blade.

13. The electric shaver according to claim 4, wherein said driver has a transmission member which transmits reciprocal motion to said joint provided in said inner blade.

14. The electric shaver according to claim 4, further comprising a member for preventing detachment of said driver from said joint in said inner blade.

15. The electric shaver according to claim 5, wherein said driver has a transmission member which transmits reciprocal motion to said joint provided in said inner blade.

16. The electric shaver according to claim 5, further comprising a member for preventing detachment of said driver from said joint in said inner blade.

17. The electric shaver according to claim 6, wherein said driver has a transmission member which transmits reciprocal motion to said joint provided in said inner blade.

18. The electric shaver according to claim 6, further comprising a member for preventing detachment of said driver from said joint in said inner blade.

19. The electric shaver according to claim 7, further comprising a member for preventing detachment of said driver from said joint in said inner blade.

20. The electric shaver according to claim 8, further comprising a member for preventing detachment of said driver from said joint in said inner blade.

* * * * *